US011553279B1

(12) United States Patent
Futtrup

(10) Patent No.: US 11,553,279 B1
(45) Date of Patent: Jan. 10, 2023

(54) ELECTROMAGNETIC TRANSDUCER AND LOUDSPEAKER

(71) Applicant: SEAS Fabrikker AS, Moss (NO)

(72) Inventor: Claus Futtrup, Herning (DK)

(73) Assignee: SEAS Fabrikker AS, Moss (NO)

( * ) Notice: Subject to any disclaimer, the term of this patent is extended or adjusted under 35 U.S.C. 154(b) by 0 days.

(21) Appl. No.: 17/515,551

(22) Filed: Nov. 1, 2021

(51) Int. Cl.

| | |
|---|---|
| ***H04R 9/02*** | (2006.01) |
| ***H04R 7/12*** | (2006.01) |
| ***H04R 9/06*** | (2006.01) |
| ***H04R 7/18*** | (2006.01) |

(52) U.S. Cl.
CPC ..... *H04R 9/025* (2013.01); *H04R 7/12* (2013.01); *H04R 7/18* (2013.01); *H04R 9/06* (2013.01); *H04R 2400/11* (2013.01)

(58) Field of Classification Search
CPC . H04R 9/025; H04R 7/12; H04R 7/18; H04R 9/06; H04R 2400/11; H04R 1/30; H04R 2201/34; H04R 9/045
See application file for complete search history.

(56) References Cited

U.S. PATENT DOCUMENTS

| | | | | |
|---|---|---|---|---|
| 4,661,973 | A * | 4/1987 | Takahashi | H04R 9/025 379/199 |
| 2004/0131223 | A1* | 7/2004 | Stiles | H04R 9/063 381/412 |
| 2007/0230737 | A1* | 10/2007 | Hyde | H04R 9/063 381/396 |
| 2021/0227331 | A1* | 7/2021 | Oclee-Brown | H04R 9/025 |

FOREIGN PATENT DOCUMENTS

JP H05142018 A * 6/1993

* cited by examiner

*Primary Examiner* — Angelica M McKinney
(74) *Attorney, Agent, or Firm* — JCIPRNET

(57) ABSTRACT

An electromagnetic transducer includes a yoke, a first magnet, a second magnet, and a spacer. The yoke is disposed along a vertical axis. The first magnet is magnetically coupled to the yoke and has a polarization in a first orientation with respect to the vertical axis. The second magnet is magnetically coupled to the yoke and has a polarization in the first orientation with respect to the vertical axis. The spacer is disposed between the first magnet and the second magnet and is extended along the vertical axis.

16 Claims, 8 Drawing Sheets

ELECTROMAGNETIC TRANSDUCER AND LOUDSPEAKER

BACKGROUND OF THE DISCLOSURE

1. Field of the Disclosure

The disclosure relates to an electromagnetic transducer and a loudspeaker, and more particularly, to the electromagnetic transducer and the loudspeaker having separate magnets arranged in tandem.

2. Description of Related Art

An electromagnetic transducer can be utilized in a loudspeaker to transform an electrical signal into an acoustical signal. In addition, the electromagnetic transducer includes magnets that provides magnetic field throughout the loudspeaker. In performing operation of the loudspeaker, electrical signals are transmitted as an alternating current through a voice coil, and the alternating current can interact with the magnetic field generated from the magnets.

In the conventional designs of the loudspeaker, by replacing a larger magnet, typically a ferrite magnet, with a smaller magnet, for example, a neodymium magnet, although the overall weight of the magnet assembly of the loudspeaker can be desirably reduced, negative effects would be generated on force factor nonlinearity. Namely, the neodymium magnets with thinner flat disk designs are not feasible for conventional long-stroke applications.

SUMMARY OF THE DISCLOSURE

The disclosure provides an electromagnetic transducer which can enhance force factor linearity thereof.

The disclosure provides a loudspeaker having reduced dimension and weight with long-stroke linearity.

The disclosure provides an electromagnetic transducer. The electromagnetic transducer includes a yoke, a first magnet, a second magnet, and a spacer. The yoke is disposed along a vertical axis. The first magnet is magnetically coupled to the yoke and has a polarization in a first orientation with respect to the vertical axis. The second magnet is magnetically coupled to the yoke and has a polarization in the first orientation with respect to the vertical axis. The spacer is disposed between the first magnet and the second magnet and is extended along the vertical axis.

The disclosure provides a loudspeaker. The loudspeaker includes a frame, a diaphragm assembly, and an electromagnetic transducer. The diaphragm damper is coupled to the frame and comprising a voice coil. The electromagnetic transducer is coupled to the frame. The electromagnetic transducer includes a yoke, a first magnet, a second magnet, and a spacer. The yoke has a vertical axis and a through hole penetrating through the yoke along the vertical axis. The first magnet surrounds and is magnetically coupled to the yoke with an air gap existed therebetween. The first magnet has a polarization in a first orientation with respect to the vertical axis. The second magnet surrounds and is magnetically coupled to the yoke with the air gap existed therebetween. The second magnet has a polarization in the first orientation with respect the vertical axis. The spacer surrounds the yoke and is magnetically coupled and connected between the first magnet and the second magnet.

In order to make the foregoing features and advantages of the disclosure more comprehensible, embodiments are hereinafter described in detail with reference to the accompanying drawings.

DESCRIPTION OF THE EMBODIMENTS

Figure 1:
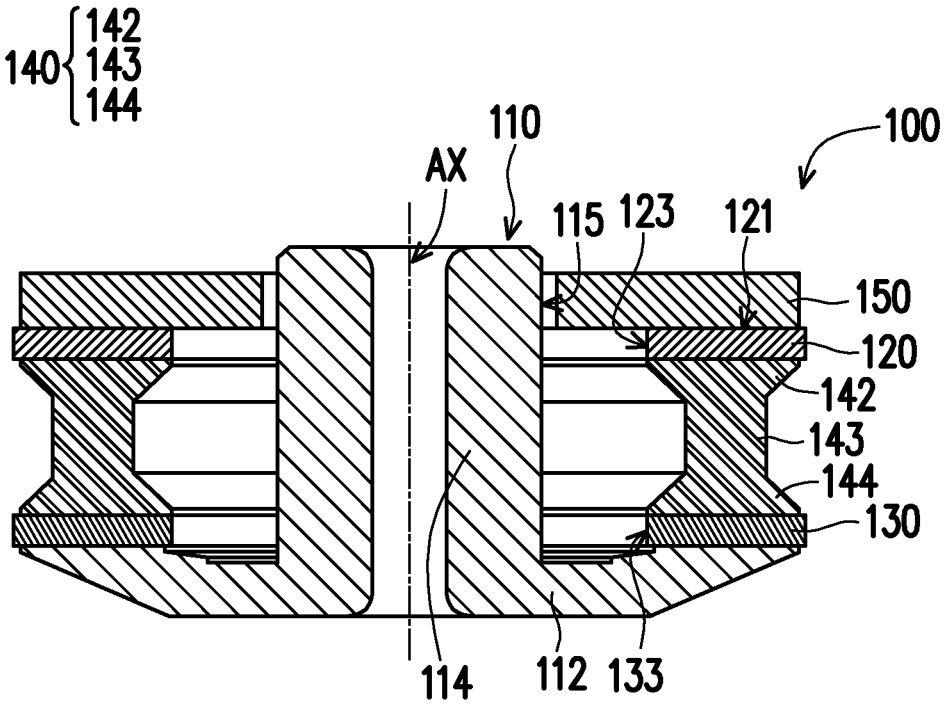
FIG. 1 is a schematic diagram of an electromagnetic transducer according to some exemplary embodiments of the present disclosure.

FIG. 1 is a schematic diagram of an electromagnetic transducer 100 according to an embodiment of the disclosure. The electromagnetic transducer 100 includes a yoke 110, a first magnet 120, a second magnet 130, and a spacer 140. In some embodiments, the yoke 110 is disposed along a vertical axis AX. In some embodiments, the first magnet 120 is magnetically coupled to the yoke 110, and the first magnet 120 has a polarization in a first orientation with respect to the vertical axis AX. In some embodiments, the first orientation is a direction along the magnetic flux orientated from the first magnet 120 toward the second magnet 130.

In some embodiments, the second magnet 130 is magnetically coupled to the yoke 110, and the second magnet 130 has a polarization in the same first orientation with respect to the vertical axis AX as the first magnet 120. The spacer 140 is disposed between the first magnet 120 and the second magnet 130, and the spacer 140 surrounds about and is extended along the vertical axis AX. In the present embodiment, the first magnet 120 and the second magnet 130 are arranged in tandem and spaced part from each other through the spacer 140 interposed therebetween. In some embodiments, both the first magnet 120 and the second magnet 130 may be neodymium magnets. In some embodiments, the first magnet 120 and the second magnet 130 may be formed by other permanent magnetic materials. In some embodiments, the first magnet 120 and the second magnet 130 may be formed, for example, in a disc shape, a plate shape, or any other suitable shapes.

Referring to FIG. 1, in some embodiments, the electromagnetic transducer 100 includes a magnetically conductive plate 150, and the magnetically conductive plate 150 is magnetically coupled with and connected to the first magnet 120. As shown in FIG. 1, an air gap 115 is located between the yoke 110 and the magnetically conductive plate 150. Moreover, the air gap 115 is extended along the vertical axis AX and annularly surrounds the yoke 110. In some embodiments, the yoke 110 includes a plate portion 112 and a pole piece 114. The plate portion 112 is radially extended with respect to the vertical axis AX, and the pole piece 114 is connected to the plate portion 112 and vertically extended along the vertical axis AX. In the present embodiment, the magnetic flux is transmitted through the air gap 115 from the pole piece 114 of the yoke 110 to the magnetically conductive plate 150.

Figure 2A:
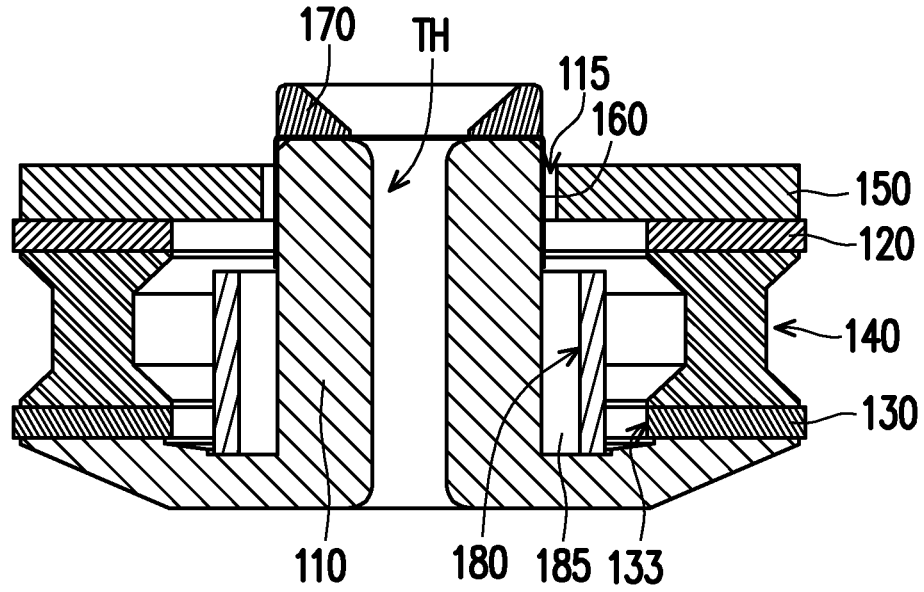
FIG. 2A is a schematic diagram of an electromagnetic transducer according to some exemplary embodiments of the present disclosure.
Figure 2B:
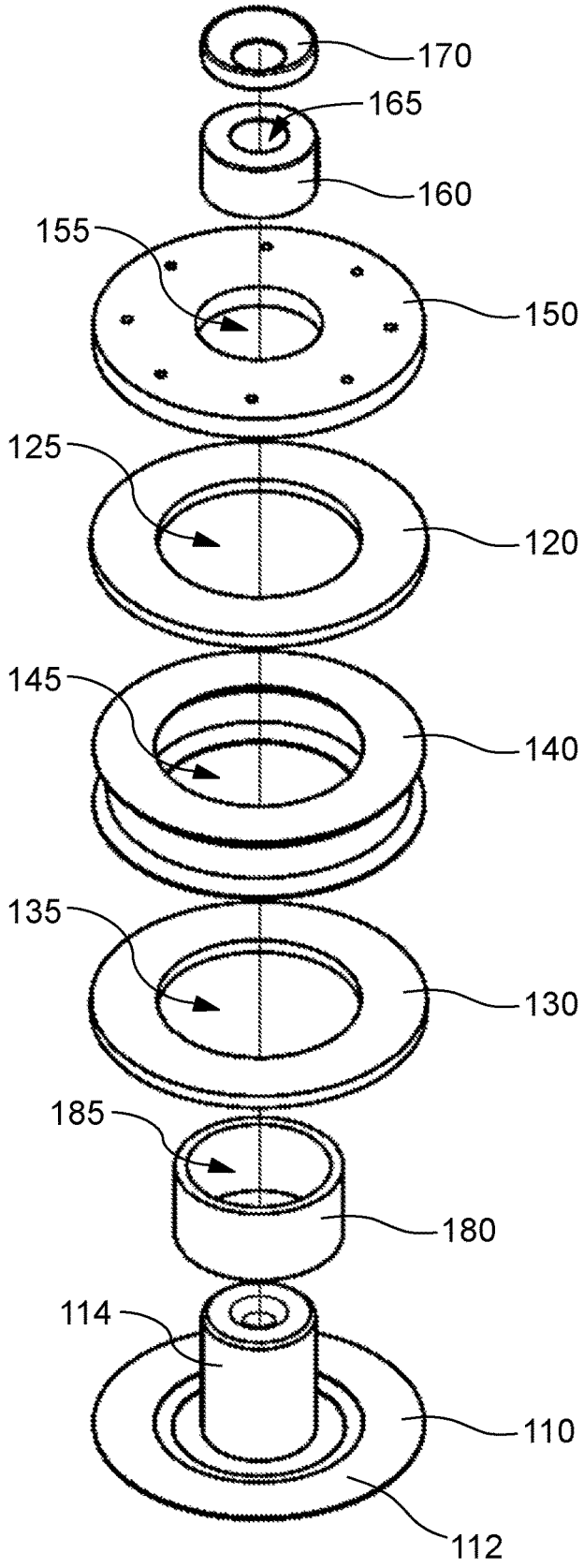
FIG. 2B is a schematic exploded view of the electromagnetic transducer of FIG. 2A according to some exemplary embodiments of the present disclosure.
Figure 3:
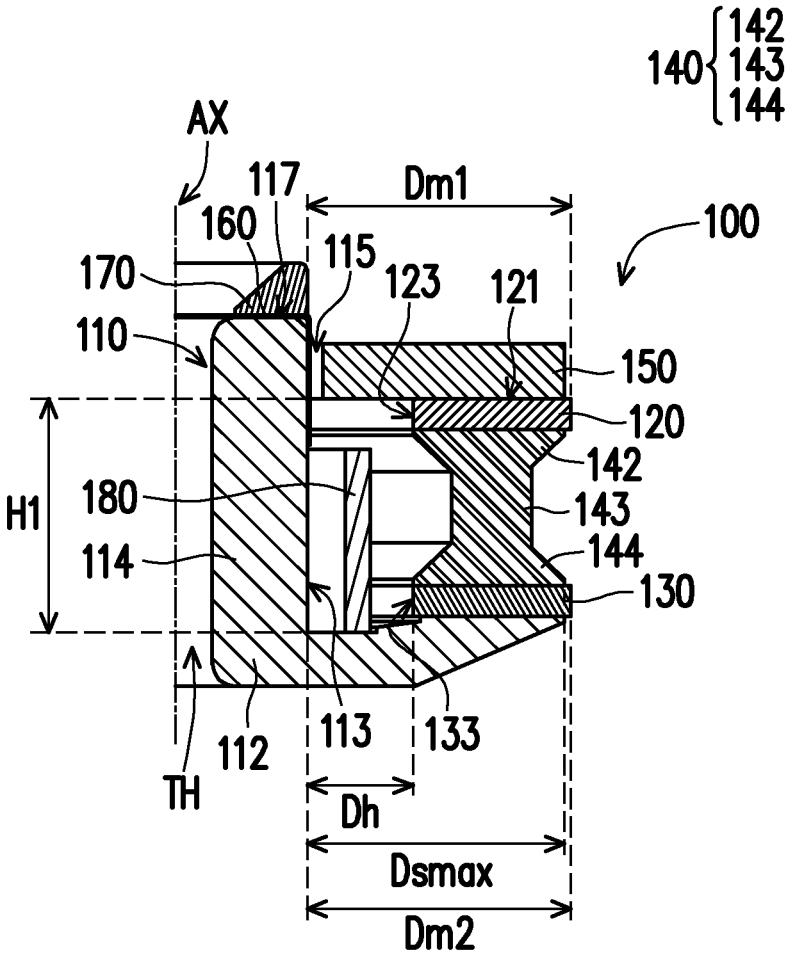
FIG. 3 is a schematic partial view of the electromagnetic transducer of FIG. 2A according to some exemplary embodiments of the present disclosure.

FIG. 2A is a schematic diagram of an electromagnetic transducer 100 according to some exemplary embodiments of the present disclosure. FIG. 2B is a schematic exploded view of the electromagnetic transducer 100 of FIG. 2A according to some exemplary embodiments of the present disclosure. FIG. 3 is a schematic partial view of the electromagnetic transducer 100 of FIG. 2A according to some exemplary embodiments of the present disclosure. Referring to FIG. 1, FIG. 2A, FIG. 2B, and FIG. 3, the electromagnetic transducer 100 includes a metal cap 160, and the metal cap 160 covers a top surface 117 of the pole piece 114 and annularly surrounds a side surface 113 of the pole piece 114. Referring to FIG. 2A, FIG. 2B, and FIG. 3, the electromagnetic transducer 100 includes a metal horn 170 disposed above the top surface 117 of the yoke 110. Moreover, the metal cap 160 is interposed between the metal horn 170 and the pole piece 114 of the yoke 110, and the metal horn 170 sits above the metal cap 160. In some embodiments, the metal horn 170 may be formed by a metal material, for example, aluminum. In some other embodiments, the metal cap 160 may be also formed by, for example, copper.

As shown in FIG. 2B, in some embodiments, the first magnet 120 and the second magnet 130 are formed in disc shapes respectively having apertures 125, 135 axially penetrating therethrough. In some embodiments, the spacer 140 may be formed in a hollow cylindrical shape with an aperture 145 axially penetrating therethrough. In some embodiments, the magnetically conductive plate 150 also includes an aperture 155 axially penetrating therethrough. Referring to FIG. 2A and FIG. 2B, the pole piece 114 of the yoke 110 may be sequentially and axially inserted through the aperture 135 of the second magnet 130, the aperture 145 of the spacer 140, the aperture 125 of the first magnet 120, and the aperture 155 of the magnetically conductive plate 150. As a result, the pole piece 114 is axially protruded from the magnetically conductive plate 150 shown in FIG. 2A. As shown in FIG. 2A and FIG. 2B, the metal cap 160 may also include an aperture 165, and the top surface 117 of the pole piece 114 is axially inserted into the aperture 165 of the metal cap 160. In some embodiments, the metal horn 170 can be disposed axially to sit above both of the metal cap 160 and the pole piece 114 of the yoke 110.

In some embodiments, the metal horn 170 can be disposed for guiding the air flow into the center of the pole piece 114 for improving air circulation inside of the electromagnetic transducer 100 and enhancing heat dissipation therein. In the present embodiment, through the above configuration of the metal horn 170, the air-turbulence noise inside of the electromagnetic transducer 100 can be also reduced.

In some embodiments, as shown in FIG. 2A, a through hole TH may be disposed by axially penetrating the pole piece 114 of the yoke 110 to have a hollow cylindrical shape therein. In the present embodiment, by disposing the through hole TH formed in the pole piece 114 of the yoke 110, an overall weight of the electromagnetic transducer 100 can be reduced by such a hollow cylindrical structure. Moreover, the through hole TH can allow airflow in and out of the electromagnetic transducer 100 to improve cooling and heat dissipation thereof. In some other embodiments not illustrated, the pole piece 114 may not include any through hole penetrating therethrough.

Referring again to FIG. 3, the plate portion 112 of the yoke 110 is horizontally and radially extended toward the second magnet 130 with respect to the vertical axis AX. Moreover, the pole piece 114 of the yoke 110 is extended along the vertical axis AX and a vertical aligning direction of the first magnet 120 and the second magnet 130. As shown in FIG. 3, a distance Dh between the pole piece 114 and an inner side wall 123 of the first magnet 120 and between the pole piece 114 and an inner sider wall 133 of the second magnet 130 is substantially greater than or equal to one third of a vertical distance H1 between a top surface 121 of the first magnet 120 and the plate portion 112 of the yoke 110 as shown in FIG. 3. It is noted as $$Dh \geq \frac{1}{3}H1.$$

Through such ratio between the distance Dh and the vertical distance H1, a larger distance Dh may avoid the magnetic flux traveling through wrong routes when a soft-magnetic spacer is disposed between the first magnet 120 and the second magnet 130. In addition, through such configuration, the spacer 140 can conduct the flux field from the top of the first magnet 120 to the bottom of the second magnet 120 without loss of the magnetic flux.

In some embodiments, the first magnet 120 is magnetically coupled in tandem with the second magnet 130. Additionally, the first magnet 120 and the second magnet 130 are polarized in the same orientation such that the magnetic flux flows along the same direction as the polarized direction of the first magnet 120 and the second magnet 130. For example, north poles of the first magnet 120 and the second magnet 130 may both vertically face the upper side the electromagnetic transducer 100, that is, being disposed close to upper surfaces of the first magnet 120 and second magnet 130. Namely, the second magnet 130 is oriented with its magnetic flux in the same direction as the first magnet 120. For example, in the present embodiment, the magnetic flux may flow along a direction oriented from the first magnet 120 to the second magnet 130 and may flow from the second magnet 130 sequentially across the plate portion 112 and the pole piece 114 of the yoke 110, the magnetically conductive plate 150, and reach back to the first magnet 120.

In some embodiments, the first magnet 120 and the second magnet 130 may include high energy magnets, such as neodymium magnets. In the present embodiment, by interposing the spacer 140 between the first magnet 120 and the second magnet 130, the spacer 140 can conduct a magnetic flux field oriented from the first magnet 120 toward the second magnet 130. In the present embodiment, instead of configuring a single magnet, typically formed by a ferrite magnet having a thicker thickness, two separate magnets, the first magnet 120 and the second magnet 130, with the spacer 140 disposed therebetween are vertically disposed and aligned in tandem and configured in the electromagnetic transducer 100, the distortion at high excursion can be desirably reduced and the overall weight and dimensions of the electromagnetic transducer 100 can be also desirably decreased. In some embodiments, the overall weight of the electromagnetic transducer 100 may be reduced by substantially 40% compared to a scenario of configuring a typical ferrite magnet. Hence, a better sound quality can be derived from a smaller and/or lighter system of the electromagnetic transducer 100 due to longer linear excursion designs resulted from configuring the electromagnetic transducer 100 having a smaller diameter into a smaller housing box without sacrificing max output level of the loudspeaker or the level of the distortion of the electromagnetic transducer 100.

Referring again to FIG. 3, an outer diameter Dm1 of the first magnet 120 and an outer diameter Dm2 of the second magnet 130 are both substantially greater than or equal to a maximum outer diameter Dsmax of the spacer 140. It is noted as Dm1≥Dsmax, Dm2≥Dsmax. Through the above-mentioned configuration of the outer diameter Dm1 of the first magnet 120 and the outer diameter Dm2 of the second magnet 130 in relative to the maximum outer diameter Dsmax of the spacer 140, the complexity of assembling the electromagnetic transducer 100 can be reduced and magnetic shunt in the edges of the first magnet 120 and the second magnet 130 can be further avoided.

Figure 4:
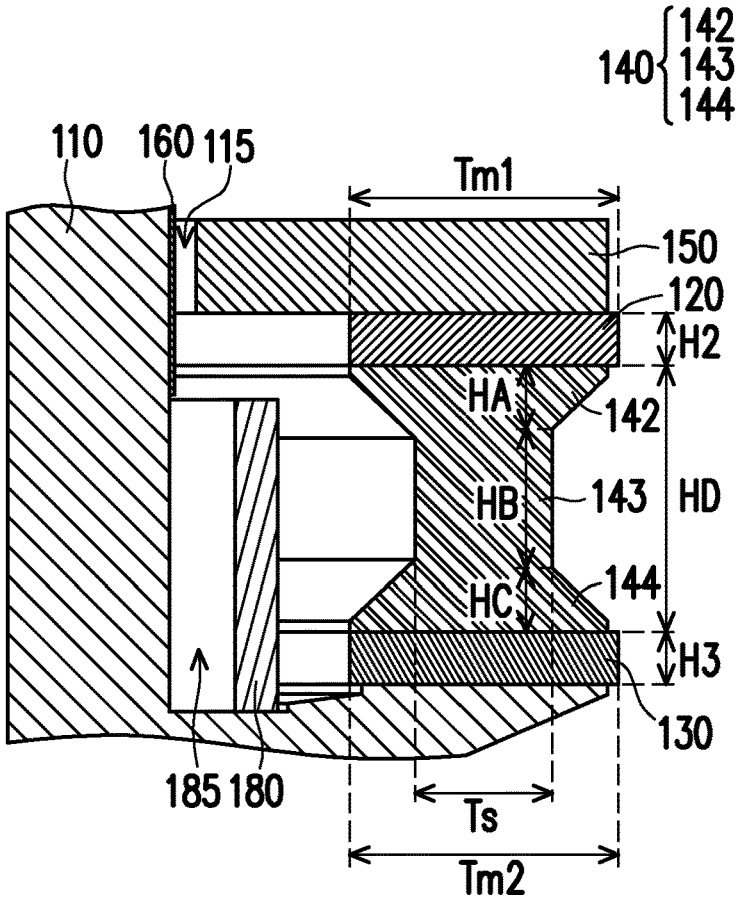
FIG. 4 is a schematic partial view of the electromagnetic transducer of FIG. 2A according to some exemplary embodiments of the present disclosure.

FIG. 4 is a schematic partial view of the electromagnetic transducer of FIG. 2A according to some exemplary embodiments of the present disclosure. Referring to FIG. 4, in some embodiments, the spacer 140 may include a first shrinking portion 142, a second shrinking portion 144, and a uniform portion 143. In the present embodiment, the first shrinking portion 142 is magnetically coupled with and physically connected to first magnet 120. Moreover, the second shrinking portion 144 is magnetically coupled with and physically connected to the second magnet 130. The uniform portion 143 is interposed between and extended from the first shrinking portion 142 to the second shrinking portion 144 in a uniform thickness. Referring again to FIG. 4, in the present embodiment, the first shrinking portion 142 has a thickness gradually reduced from the first magnet 120 toward the uniform portion 143. Moreover, the second shrinking portion 144 has a thickness gradually reduced from the second magnet 130 toward the uniform portion 143.

In the present embodiment, through configuration of the first shrinking portion 142, the second shrinking portion 144, and the uniform portion 143 interposed therebetween, the overall dimensions and weight of the spacer 140 can be further reduced and thus to decrease the overall dimensions and weight of the electromagnetic transducer 100.

As shown in FIG. 4, a horizontal thickness Ts of the uniform portion 143 is substantially one half of a horizontal thickness Tm1 of the first magnet 120 or one half of a horizontal thickness Tm2 of the second magnet 130. It can be noted as $$Ts = \frac{1}{2}Tm1 \text{ or } Ts = \frac{1}{2}Tm2.$$

In the present embodiment, the magnetic flux of the spacer 140 is two times than the first magnet 120 and the second magnet 130, the horizontal thickness ratio between the uniform portion 143 of spacer 140 and the first magnet 120 or the second magnet 130 is related to the ratio of magnetic flux between the spacer 140 and the first magnet 120 or the second magnet 130. In addition, through configuring the horizontal thickness Ts of the uniform portion 143 as one half of the horizontal thickness Tm1 of the first magnet 120 or the horizontal thickness Tm2 of the second magnet 130, the overall dimension and weight of the spacer 140 can be reduced, and thus the dimension and weight of the electromagnetic transducer 100 can be also reduced accordingly.

Referring again to FIG. 4, a vertical height HA of the first shrinking portion 142 is substantially same as a vertical height HC of the second shrinking portion 144. It is noted as HA=HC. In the present embodiment, through configuring the vertical height HA of the first shrinking portion 142 to be substantially the same as the vertical height HC of the second shrinking portion 144, the uniform portion 143 can have equal distances respectively toward the first magnet 120 and the second magnet 130 for providing sufficient space to conduct flux field from the top of the first magnet 120 to the bottom of the second magnet 120 without loss of the magnetic flux. Hence, a shrinkage ratio of the first shrinking portion 142 from the first magnet 120 to the uniform portion 143 is same as a shrinkage ratio of the second shrinking portion 144 from the second magnet 130 to the uniform portion 143.

In some embodiments, the first shrinkage portion 142 is inclined from the first magnet 120 to the uniform portion 143 in a range substantially from 30 degrees to 60 degrees. Moreover, the second shrinkage portion 144 is also inclined from the second magnet 130 to the uniform portion 143 in a range substantially from 30 degrees to 60 degrees. In some embodiments, the electromagnetic transducer 100 can include a metal ring 180 surrounding the pole piece 114 of the yoke 110 and annularly disposed between the spacer 140 and the yoke 110. As shown in FIG. 2A, FIG. 2B, and FIG. 4, the metal ring 180 has an aperture 185 annularly surrounding about the vertical axis AX and the pole piece 114 of the yoke 110, and a gap is thus defined between the pole piece 114 and the metal ring 180. In some embodiments, the metal ring 180 may be formed by, for example, an aluminum ring. In the present embodiment, the metal ring 180, the metal cap 160, and the metal horn 170 can be electrically conductive short-circuit elements strategically placed in the electromagnetic motor to improve the inductance-versus-excursion performance.

In some embodiments, as illustrated in FIG. 4, a vertical height HD of the spacer 140 is greater than two times of a sum of a first vertical height H2 of the first magnet 120 and a second vertical height H3 of the second magnet 130. Namely, it can be noted as HD≥2×(H2+H3). In the present embodiment, due to the above configuration of the spacer 140 with respect to the first magnet 120 and the second magnet 130, the performance characteristics of the electromagnetic transducer 100 can be substantially equal to or exceed a conventional long-stroke design utilizing the typical thick ferrite magnets.

In some embodiments, the first vertical height H2 of the first magnet 120 is substantially the same as the second vertical height H3 of the second magnet 130. It can be noted as H2=H3. In the above embodiment, due to the first magnet 120 and the second magnet 130 having an identical vertical height, the first magnet 120 and the second magnet 130 can be equally disposed on the top and the bottom of the spacer 140 in a tandem manner. In some other embodiments not illustrated, the first vertical height H2 of the first magnet 120 and the second vertical height H3 of the second magnet 130 may be different from each other. In some other embodiments, shapes, dimensions, or the weights of the first magnet 120 and the second magnet 130 may be also different from each other.

Figure 5:
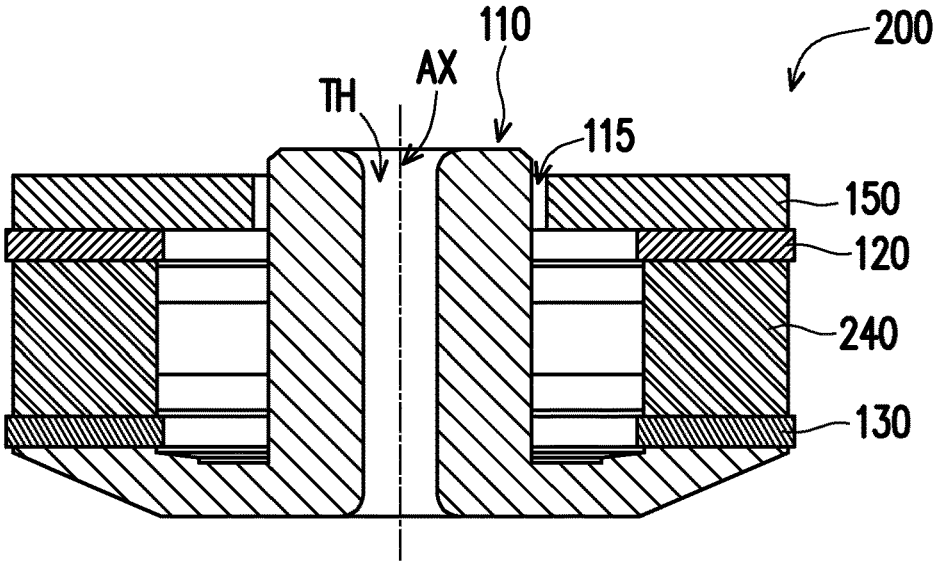
FIG. 5 is a schematic diagram of an electromagnetic transducer according to some exemplary embodiments of the present disclosure.

FIG. 5 is a schematic diagram of an electromagnetic transducer according to some exemplary embodiments of the present disclosure. Referring to FIG. 5, in the present embodiment, the electromagnetic transducer 200 may include a spacer 240 disposed between the first magnet 120 and the second magnet 130. In the present embodiment, different from the spacer 140 illustrated in the embodiments of FIG. 1 to FIG. 4, the spacer 240 shown in FIG. 5 has no shrinking portions connected to both the first magnet 120 or the second magnet 130. Instead, the spacer 240 is in a cylindrical shell shape. Namely, the spacer 240 has a consistent thickness extended from the first magnet 120 to the second magnet 130. In some other embodiments not illustrated, the thickness and shape of the spacer 240 may be configured and adjusted depending on the density of the magnetic flux passing therethrough.

In some embodiments not illustrated, the spacer 140 may include a plurality of through holes horizontally extended through the spacer 140 and disposed in an equal distribution along an extending direction of the spacer 140 along the vertical axis AX. In the present embodiment, with the through holes of the spacer 140 horizontally extended therethrough, the air can be allowed to flow from the region in the gap between the spacer 140 and the yoke 110, which is closed to the pole piece 114, to the region outside of the electromagnetic transducer 100 and peripherally surrounding the electromagnetic transducer 100. Accordingly, the magnetic flux running through the spacer 140 can be affected by the air flow in a uniform manner.

Figure 6A:
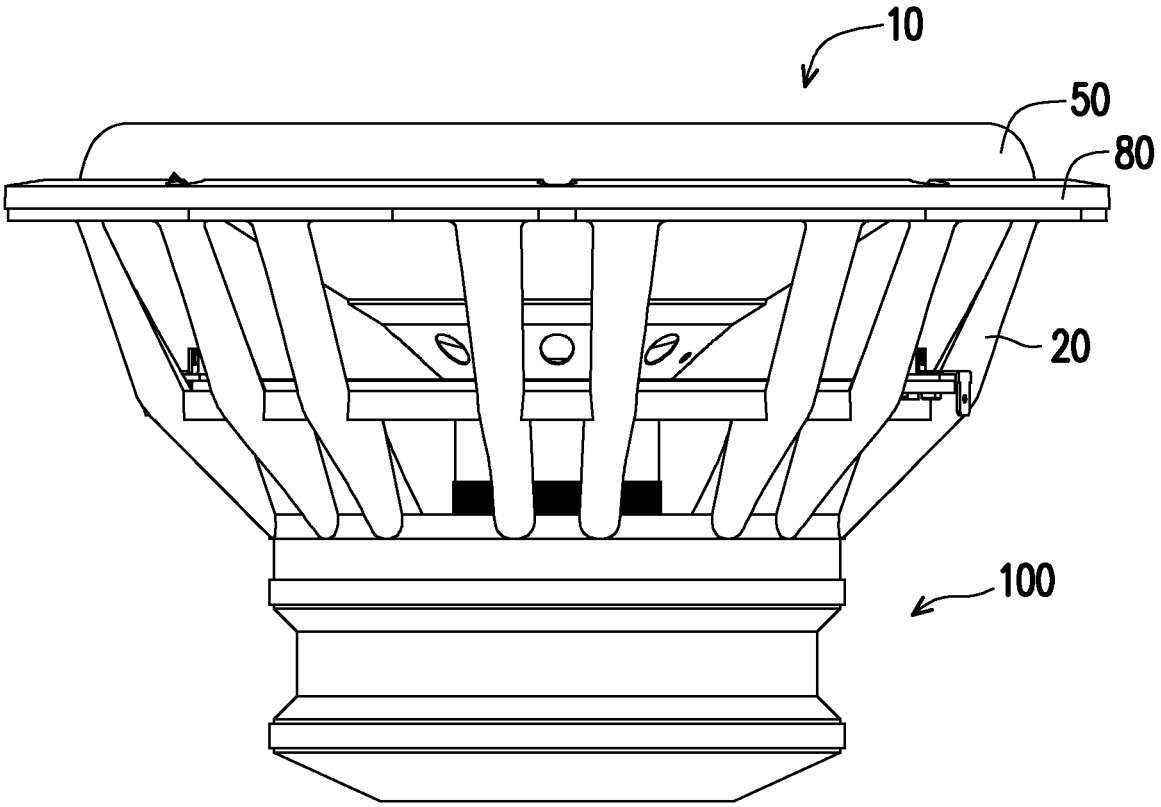
FIG. 6A is a schematic diagram of a loudspeaker according to some exemplary embodiments of the present disclosure.
Figure 6B:
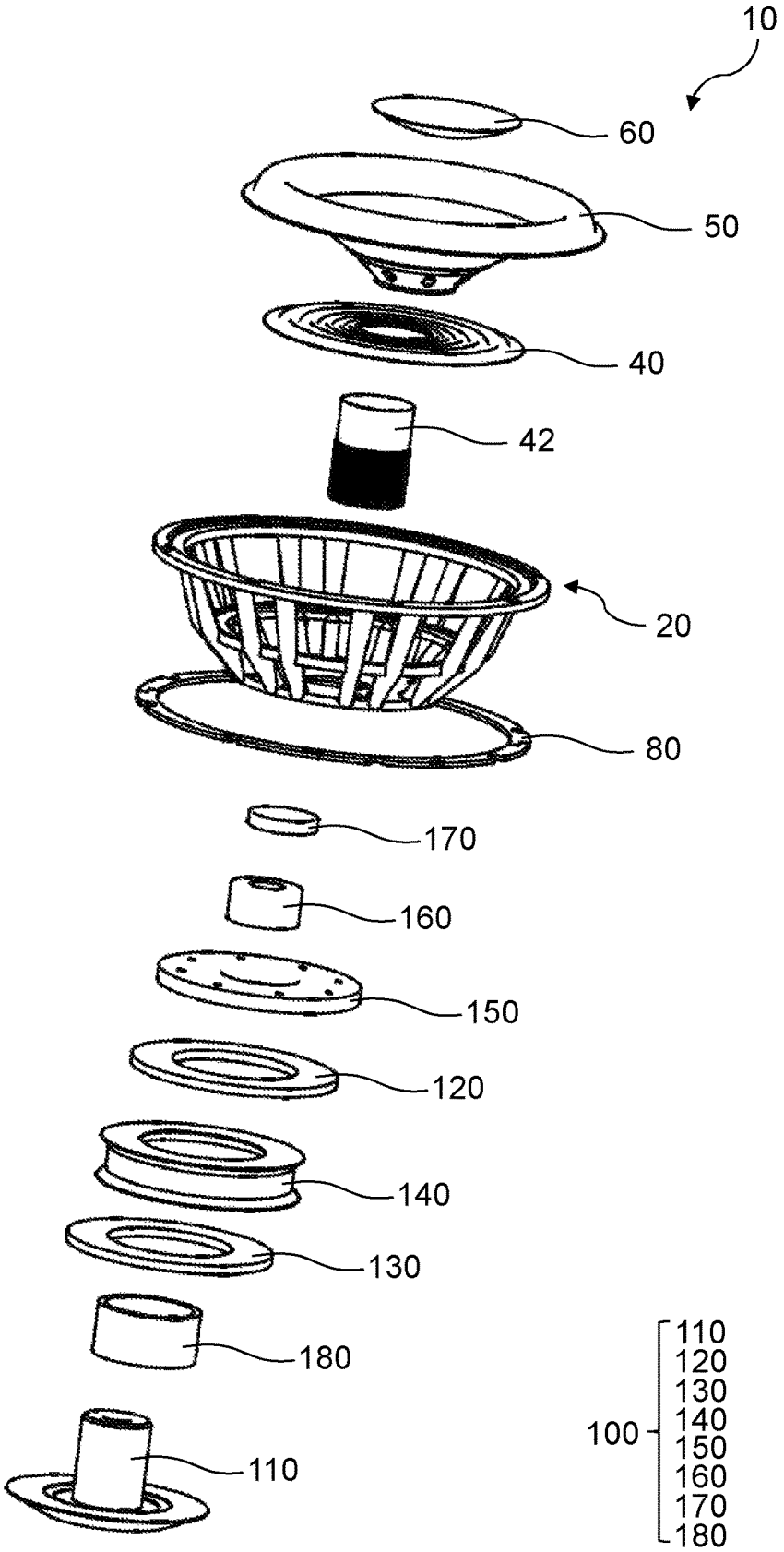
FIG. 6B is a schematic exploded view of the loudspeaker of FIG. 6A according to some exemplary embodiments of the present disclosure.

FIG. 6A is a schematic diagram of a loudspeaker 10 according to some exemplary embodiments of the present disclosure. FIG. 6B is a schematic exploded view of the loudspeaker of FIG. 6A according to some exemplary embodiments of the present disclosure. Referring to FIG. 6A and FIG. 6B, in some embodiments, the loudspeaker 10 includes a frame 20, a diaphragm assembly, and the electromagnetic transducer 100 as described above and illustrated in FIG. 1 to FIG. 4, the diaphragm assembly includes a damper 40 and a voice coil 42. In some embodiments, the damper 40 is coupled to frame 20, and the voice coil 42 is coupled between the frame 20 and the damper 40. Moreover, the electromagnetic transducer 100 is coupled to the frame 20. In some embodiments, the voice coil 42 may move up and down along the vertical axis AX of the electromagnetic transducer 100.

In some embodiments, the voice coil 42 may be constructed from an elongated conductive element, such as axially wounded wire in a generally cylindrical or helical manner. In the present embodiment, the voice coil 42 is mechanically coupled to the damper 40 though suitable means that enables the oscillating voice coil 42 to consequentially actuate or drive the damper 40 in an oscillating manner and thus producing mechanical sound energy correlating to the electrical signals transmitted through the voice coil 42.

Specifically, electrical signals can be transmitted as an alternating current through the voice coil 42, and the alternating current interacts with the magnetic field generated from the first magnet 120 and the second magnet 130. The alternating current actuates the voice coil 42 to axially reciprocate back and forth and correspondingly move the damper 40.

In some other embodiments, as shown in FIG. 6B, the loudspeaker 10 may further include a cone 50, a dust cap 60, and a gasket 80. In some embodiments, the cone 50 is coupled to the damper 40. In addition, the dust cap 60 is disposed above the cone 50 and the damper 40 to seal the magnetic air gaps therein and protects against infiltration of dust particles and other stray materials which might contaminate the magnetic air gaps and thus interfere with the operation or quality of the loudspeaker 10. Moreover, referring again to FIG. 6A and FIG. 6B, the cone 50 can be coupled to the frame 20. In some embodiments, the electromagnetic transducer 100 may be attached to the fame 20 through an adhesive.

Figure 7:
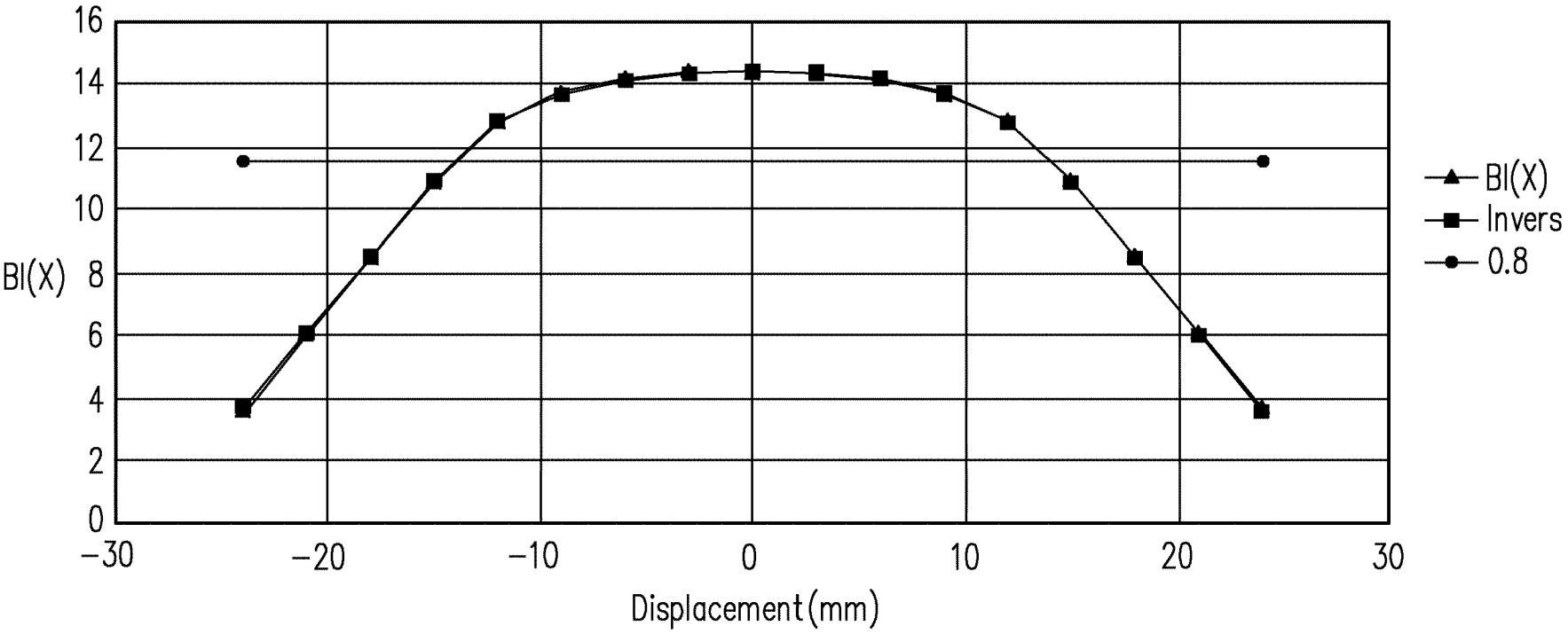
FIG. 7 is a chart illustrating a relation between a force factor linearity and a displacement (excursion) of a voice coil according to an embodiment of the present disclosure.

FIG. 7 is a chart illustrating a relation between a force factor linearity and a displacement (excursion) of the voice coil 42 according to an embodiment of the disclosure. Referring to FIG. 7, the line B(X) indicates an excellent symmetry of the force factor linearity. In addition, in FIG. 7, the line "inverse" indicates the symmetry of the force factor linearity to the different displacements (excursions) of the voice coil 42 in a unit of millimeter with respect to the electromagnetic transducer 100. In addition, the line "0.8" is set as a reference line to appraise the symmetry of the force factor linearity. As shown in FIG. 7, the line "inverse" closely follows the line B(X), which shows an excellent symmetry of the force factor linearity in the present embodiment.

Figure 8:
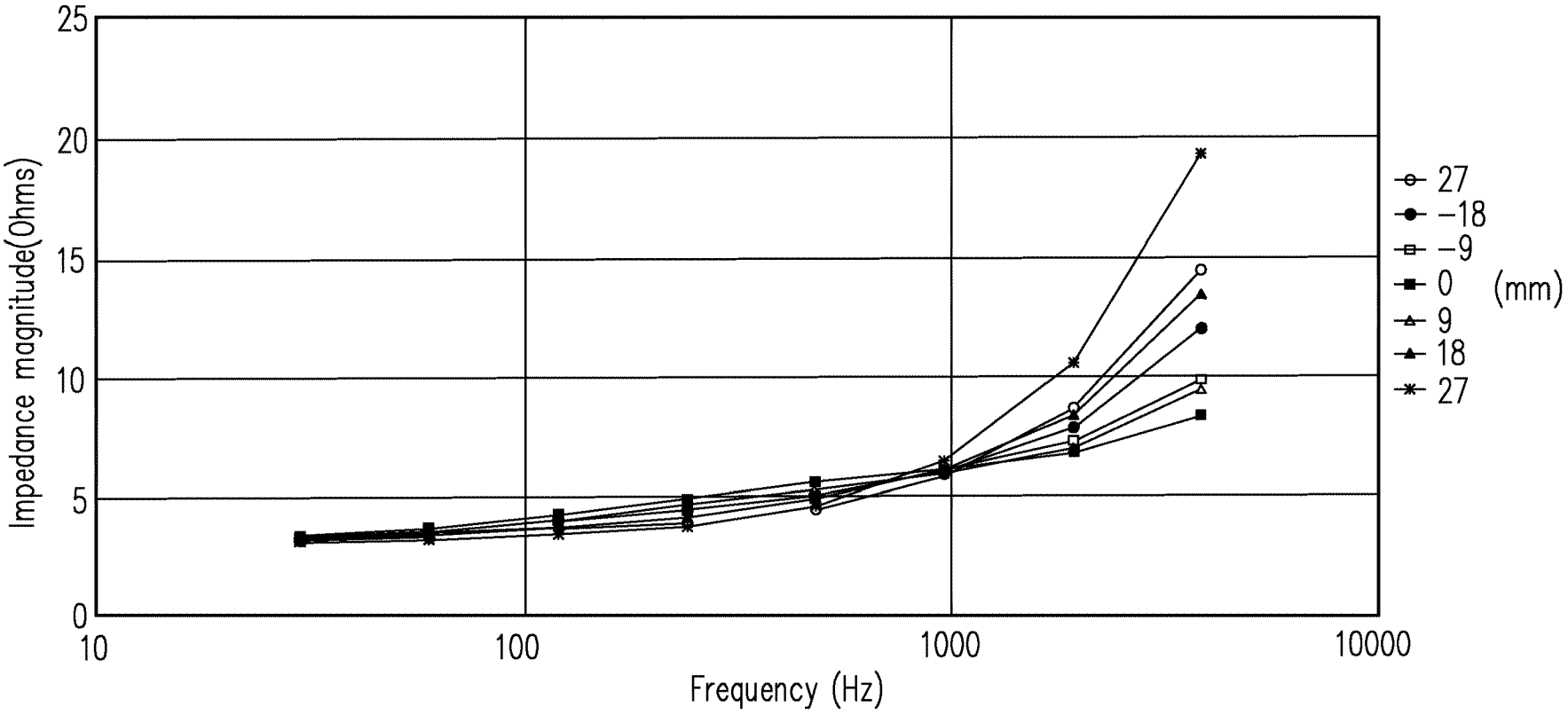
FIG. 8 is a chart illustrating a relation between an impedance magnitude and frequency plot at different displacements (excursion) of a voice coil according to an embodiment of the present disclosure.

FIG. 8 is a chart illustrating a relation between an impedance magnitude and frequency plot at difference displacements of a voice coil according to an embodiment of the disclosure. Referring to FIG. 8, it shows stability of the inductance magnitude of the voice coil 42 in different displacements (excursions) therefore versus frequencies. As shown in FIG. 8, through configuration of the electromagnetic transducer 100, stability of the inductance versus displacements of the voice coil 42 can be enhanced.

In summary, in the present disclosure, the two magnets, for example, the first magnet 120 and the second magnet 130 are configured in tandem along the magnetic flux orientation with the spacer 140 interposed therebetween in the electromagnetic transducer 100. Through configuring the electromagnetic transducer 100 in the loudspeaker 10, the overall system dimensions and weight of the loudspeaker 10 can be desirably reduced without sacrificing long-stroke linearity of the electromagnetic transducer 100 and max output level of the loudspeaker 10. Namely, in the system of the loudspeaker 10, a longer and higher linear excursion design with reducing distortion at a high excursion can be achieved in a system having reduced dimensions and weight.

Although the disclosure has been disclosed as above with the embodiments, the embodiments are not intended to limit the disclosure. A person with ordinary knowledge in the technical field can make some changes and modifications without departing from the spirit and scope of the disclosure. Therefore, the protection scope of the disclosure shall be subject to the attached claims.

What is claimed is:

1. An electromagnetic transducer comprising:

a yoke disposed along a vertical axis;

a first magnet magnetically coupled to the yoke and having a polarization in a first orientation with respect to the vertical axis;

a second magnet magnetically coupled to the yoke and having a polarization in the first orientation with respect to the vertical axis;

a spacer disposed between the first magnet and the second magnet and extended along the vertical axis;

a metal cap covering a top surface of the yoke and surrounding a side wall surface thereof; and a metal horn disposed above the yoke, wherein the metal cap is disposed between the metal horn and the yoke.

2. The electromagnetic transducer as claimed in claim 1, further comprising a magnetically conductive plate disposed between the first magnet and the yoke, wherein the magnetically conductive plate is magnetically coupled with and connected to the first magnet, wherein an air gap is located between the yoke and the magnetically conductive plate and extended along the vertical axis.

3. The electromagnetic transducer as claimed in claim 1, wherein the yoke comprises:

a plate portion horizontally extended toward the second magnet; and a pole piece connected to the plate portion and extended along the vertical axis, wherein a horizontal distance between the pole piece and inner side walls of the first magnet and the second magnet is greater than or equal to one third of a vertical distance between a top surface of the first magnet and the plate portion.

4. The electromagnetic transducer as claimed in claim 1, wherein the first magnet is magnetically coupled in tandem with the second magnet.

5. The electromagnetic transducer as claimed in claim 1, wherein an outer diameter of the first magnet and an outer diameter of the second magnet are greater than or equal to a maximum outer diameter of the spacer.

6. The electromagnetic transducer as claimed in claim 1, wherein the spacer has a cylindrical shell shape with a consistent thickness extended from the first magnet to the second magnet.

7. The electromagnetic transducer as claimed in claim 1, wherein the spacer comprises:

a first shrinking portion magnetically coupled with and connected to the first magnet;

a second shrinking portion magnetically coupled with and connected to the second magnet; and a uniform portion extended from the first shrinking portion to the second shrinking portion in a uniform thickness, wherein the first shrinking portion and the second shrinking portion have thicknesses respectively gradually reduced from the first magnet and the second magnet to the uniform portion.

8. The electromagnetic transducer as claimed in claim 7, a horizontal thickness of the uniform portion is one half of a horizontal thickness of the first magnet or one half of a horizontal thickness of the second magnet.

9. The electromagnetic transducer as claimed in claim 7, a vertical height of the first shrinking portion is same as a vertical height of the second shrinking portion.

10. The electromagnetic transducer as claimed in claim 7, wherein the first shrinkage portion and the second shrinkage portion are respectively inclined toward the uniform portion from the first magnet and the second magnet in a range from 30 degrees to 60 degrees.

11. The electromagnetic transducer as claimed in claim 1, further comprising a metal ring surrounding the yoke and disposed between the spacer and the yoke.

12. The electromagnetic transducer as claimed in claim 1, wherein a vertical height of the spacer is greater than two times of a sum of a first vertical height of the first magnet and a second vertical height of the second magnet.

13. The electromagnetic transducer as claimed in claim 1, wherein a first vertical height of the first magnet is the same as a second vertical height of the second magnet.

14. The electromagnetic transducer as claimed in claim 1, wherein the first magnet and the second magnet comprise neodymium magnets.

15. The electromagnetic transducer as claimed in claim 1, wherein the spacer comprises a plurality through holes horizontally extended through the spacer and disposed in an equal distribution along an extending direction of the spacer along the vertical axis.

16. A loudspeaker, comprising:

a frame;

a diaphragm assembly coupled to the frame and comprising a voice coil; and an electromagnetic transducer coupled to the frame, comprising:

a yoke having a vertical axis and a through hole penetrating through the yoke along the vertical axis;

a first magnet surrounding and magnetically coupled to the yoke with an air gap existed therebetween, wherein the first magnet has a polarization in a first orientation with respect to the vertical axis;

a second magnet surrounding and magnetically coupled to the yoke with the air gap existed therebetween, wherein the second magnet has a polarization in the first orientation with respect the vertical axis;

a spacer surrounding the yoke and magnetically coupled and connected between the first magnet and the second magnet;

a metal cap covering a top surface of the yoke and surrounding a side wall surface thereof; and a metal horn disposed above the yoke, wherein the metal cap is disposed between the metal horn and the yoke.

* * * * *